United States Patent [19]

Rosenfeld

[11] 4,028,165

[45] June 7, 1977

[54] DRY TRANSFER PRODUCT AND PROCESS

[76] Inventor: Jerome E. Rosenfeld, 1349 Lexington Ave., New York, N.Y. 10028

[22] Filed: June 14, 1976

[21] Appl. No.: 695,790

[52] U.S. Cl. ..... 156/234; 156/240; 427/147; 428/203; 428/204; 428/207; 428/914

[51] Int. Cl.[2] ..... B44C 1/16

[58] Field of Search ..... 427/147, 256, 146, 152; 428/195, 201, 202, 203, 204, 205, 206, 207, 480, 483, 914; 156/230, 234, 239, 240, 247

[56] References Cited

UNITED STATES PATENTS

| | | | |
|---|---|---|---|
| 3,519,456 | 7/1970 | Reed et al. | 428/207 |
| 3,684,545 | 8/1972 | Worrall | 428/202 |
| 3,728,210 | 4/1973 | Piron | 428/202 |

*Primary Examiner*—Thomas J. Herbert, Jr.
*Assistant Examiner*—Bruce H. Hess
*Attorney, Agent, or Firm*—Arthur A. Jacobs

[57] ABSTRACT

A dry transfer material comprising a carrier sheet coated with a polymeric coating having inked indicia printed thereon and a pressure sensitive adhesive overlying or in the plane of the indicia, the polymeric coating susceptible to penetration by the solvents employed in the formulation of the ink.

7 Claims, 2 Drawing Figures

FIG. 1
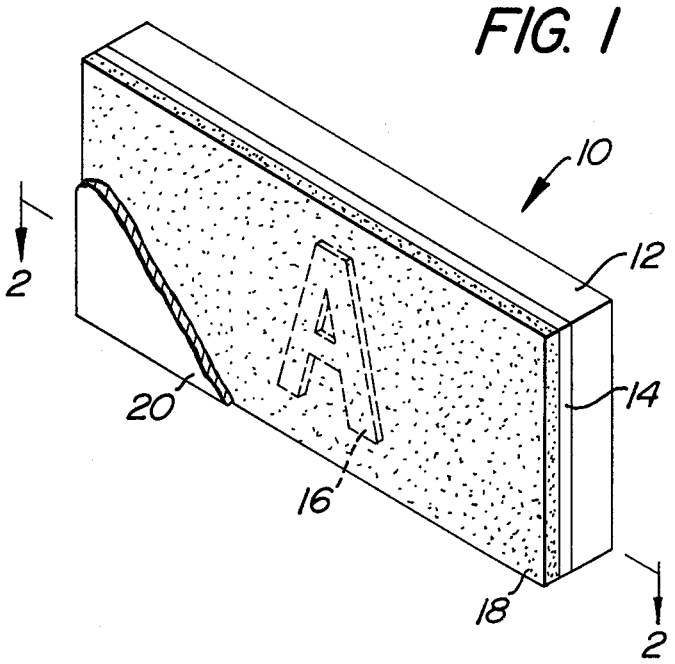
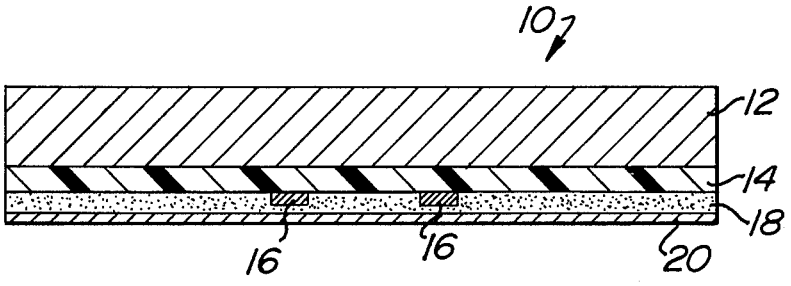
FIG. 2

DRY TRANSFER PRODUCT AND PROCESS

This invention relates to new and improved dry transfer materials and methods for their use.

The transfer of indicia from one surface to another has long been used in the graphic arts field for the creation of advertising media and art work. Among the older methods of transfer, were those which employed water to effect transfer of the indicia. These generally involved the printing of indicia upon a transparent carrier sheet adhered to a support sheet by a water-soluble adhesive. Water was used to soften the adhesive and permit removal of the transparent carrier sheet from the support sheet, after which the carrier sheet, with the indicia thereon, was applied to a receptor surface. The disadvantages of such "wet process" technique were the difficulty in positioning the carrier sheets properly, as well as the cumbersomeness of their application and their unsuitability for many purposes.

More recently, a number of techniques have been developed which eliminate the need for treatment with water to effect release from the support sheet. These are generally referred to as "dry transfer" processes.

The elements of the more advanced "dry transfer" techniques generally involve, first, the printing of indicia upon a supporting or carrier sheet, then the superimposition of an adhesive film, having pressure-sensitive properties, upon the indicia. The image are transferred from the carrier sheet to the adhesive film by placing the laminate, adhesive side down, upon a receptor surface and applying pressure by rubbing or burnishing the back of the carrier sheet above the indicia. Due to the lower degree of adhesion of the indicia to the carrier sheet than to the pressure-sensitive adhesive, when subjected to the pressure of the burnishing or rubbing, the indicia is released from the carrier sheet to the receptor surface.

While many of the afore-described "dry transfer" techniques represent distinct improvements over the older "wet-process" method, they still have a number of difficiencies. For example, several of these "dry transfer" processes require pretreatment of the carrier sheet, prior to the application of the indicia, with materials which reduce the degree of adhesion of the indicia to the carrier sheet by providing a surface with comparatively low surface energy characteristics. Chemicals such as silicones, hydrocarbon and ester waxes, fluorochemicals, and Werner chromium complexes have been suggested for this purpose. Such treatments are not only generally expensive but result in surfaces in which it is difficult to control the degree of release. This, in turn, often causes the production of poorly defined indicia, which results in a high rate of rejection of the finished products. In addition, the release coating frequently tends to migrate into the indicia during handling and storage, resulting in transfer difficulties and poor shelf life.

In order to avoid the use of release coatings, some prior systems have employed either pigmented or unpigmented lacquer coatings having a low degree of adhesion to the supporting or carrier sheet. Such coatings employ indicia-forming systems which produce a low-adhesion film. These systems depend upon the poor wettability of the coating and the inertness of the carrier sheet, which may include a polymeric coating, to the solvents employed in the formulation of the ink to achieve low adhesion. In these systems, pressure-sensitive adhesive is applied over the indicia to effect transfer on burnishing or rubbing. A major problem with this type of process, however, is the difficulty in controlling wetting, resulting in high rejection rates due to both poor definition and premature release of indicia during storage or handling.

Still, another "dry transfer" method involves the application of indicia to a carrier sheet and coating the indicia with a pressure-sensitive adhesive. The carrier sheet that is used in this system is a material which is capable of stretching when subjected to the mechanical forces of rubbing or burnishing. The separation of the indicia occurs during the stretching of the carrier sheet. However, among the undesirable effects of the use of such an extensible carrier sheet, are distortion of the indicia during transfer onto the receptor surface and even actual cracking of the indicia film.

An object of the present invention, is to provide a new and improved "dry transfer" system which overcomes the aforesaid limitations and disadvantages of prior "dry transfer" systems.

A further object of the present invention, is to produce "dry transfer" decals with tough and durable indicia, particularly suitable for application to surfaces such as walls, furniture and other articles subject to abrasion or scratching, as well as to the action of detergents and abrasive cleaners.

Yet another object of the present invention is to provide a "dry transfer" product having uniform transfer characteristics under light rubbing or burnishing and having indefinite shelf life.

Other objects are many of the attendant advantages of this invention will be readily appreciated as the same become better understood by reference to the following description, when read in conjunction with the accompanying drawings wherein:

FIG. 1 is a perspective view of a dry transfer material embodying the present invention.

FIG. 2 is a cross-sectional view of the material of FIG. 1 as applied to a receptor sheet.

According to the present invention, a dry transfer material is provided which comprises a carrier sheet, a transferable indicia layer applied to the carrier sheet, and an outermost layer of pressure-sensitive adhesive. The carrier sheet includes a polymeric coating having a low modulus of elongation and, contrary to prior teachings, susceptible to the absorption and desorption of solvents commonly used in printing inks.

More specifically, the carrier sheet is essentially non-extensible under normal conditions of burnishing and is of pellucid quality in order to permit accurate positioning of the indicia during transfer. Acceptable carrier sheets include polyester and other light-transmitting polymer films of low-extensibility under the stresses encountered under light rubbing or burnishing conditions. These sheets preferably have thicknesses of from about 0.001 inch to about 0.010 inch. Particularly suitable are certain grades of polyester films which require tensile stresses greater than 10,000 psi to produce elongation of about 5%.

Referring in greater detail to the drawings wherein similar reference characters refer to similar parts, the dry transfer material, generally designated 10, comprises a carrier sheet or film 12 made of polyester, or the like, on which is applied a polymeric coating 14. The coating 14 should have a pellucid quality and, preferably, should have a dimensional stability similar to that of the film 12 to which it is applied. The coating may be provided in either a smooth or matte finish, but it is important that the coating be susceptible to penetration by the solvents normally employed in the formulation of printing inks, such as used to form the indicia shown in the form of a printed "A" at 16.

Surprisingly, it has been found that such inks can be applied without apparent effect on the bond between the carrier sheet and coating and without ultimate effect on the integrity of the polymeric film. This property permits a more positive and uniform control of the degree of adhesion of the indicia to the carrier sheet and greatly simplifies the problem of formulating inks to provide adequate wetting with good definition of the indicia, while maintaining a sufficient and uniform degree of adhesion of the indicia to the carrier film sufficient to prevent premature release on storage and handling.

Among the polymeric coatings which may be used for the present purpose are resins which are good film formers and which are capable of both good solvent absorption and good solvent release. Examples of such materials are phenol-formaldehyde resins, alkyds, styrenated alkyd resins, styrenated oils, rosin, maleic anhydride resins, epoxy resins, as well as certain other thermosetting and thermoplastic resins, and may be photocurable, self-curing or preformed. They may be applied by roller-coating or any other suitable means.

The following is illustrative of the invention:

EXAMPLE 1

A styrenated-alkyd resin coating was applied to a polyester film and then exposed to a number of chemicals frequently used as ink solvents. These included aromatic hydrocarbons such as benzene, toluene, xylene, trimethyl benzene, aromatic naphtha and nitroberizene; esters such as butyl acetate, amyl acetate, ethylene glycol acetate, butyl lactate and ethyl lactate; ketones such as acetophenone, methyl ethyl ketone, methyl propyl ketone, methyl amyl ketone, methyl isobutyl ketone, methyl hexyl ketone, cyclohexanone, methyl hexanone, diacetone alcohol and acetone; and ether alcohols such as butyl ether of ethylene glycol, methyl ether of ethylene glycol, butyl ether of diethylene glycol, nitropropanes, and mixtures thereof.

Penetration of each solvent into different areas of the resin was detected after brief exposures of from about 30 seconds to 5 minutes by lightly wiping the exposed area with cheese cloth to remove the polymeric coating from the supporting film.

After the solvents are removed and the coating is dried, the coating cannot be removed by ordinary wiping. As an example of this, in a series of parallel exposures, the coating was treated with the solvents mentioned above; but subsequent to an exposure of about 30 seconds to about 5 minutes, the treated coating was heated in a forced-air oven for about 5 to 10 minutes at a temperature of between about 100°– ° F. The areas of coating previously exposed to the solvent remained essentially unaffected and could not be removed by wiping; they remained intact and firmly adhered to the substrate.

Since the dry transfer products of this invention may be exposed to abrasion, the indicia-forming ink should preferably contain film-forming ingredients of high mechanical strength. These films should have a high sheen and should be tough and of high tensile strength in order to withstand the stress of burnishing and have satisfactory durability after transfer to the reception surface. Preferably, these inks are based on nitrocellulose, polyacrylate or polyvinyl chloride-polyvinyl acetate copolymers. Without being bound by any particular theory, it appears that the diffusion of solvent from the ink layer and its subsequent evaporation causes softening or plasticizing at the surface of the polymeric coating, permitting a more uniform distribution of the physical forces responsible for adhesion. In this manner, it is possible to provide the uniform but limited degree of adhesion that is required for ready release under the stress of burnishing the carrier film, while avoiding any nonuniform or premature release under ambient conditions.

A distinct advantage over prior "dry transfer" products is provided by the good wettability of the polymeric coating used in the process of the present invention. In this manner, it is possible to combine satisfactory adhesion with good indicia definition.

The adhesive, shown at 18, which is empolyed in the present invention, may be applied in register with the indicia or over both the indicia and the areas of the polymeric coating surface not covered by the indicia. Since it may be necessary to place the "dry transfer" decal against the receptor surface, shown at 20 in FIG. 2, and move it into desired position, the adhesive 18 should, preferably, be one which will be substantially non-adherent to the receptor surface 20 under light pressure but which becomes strongly adherent thereto under a heavier pressure, for example, a pressure of at least about 50 psi, which may be produced by rubbing or burnishing the supporting or carrier sheet. Pressured sensitive adhesives of this type are considered to have low dry tack.

The adhesive should be chosen so that the degree of adhesion of the adhesive to the indicia film and the adhesive film to the receptor surface is greater than that of the indicia for the polymeric coating of the carrier sheet when localized pressure is applied to the carrier sheet opposite the indicia. Additionally, it is desirable to use an adhesive which adheres to the polymeric coating to a greater degree than to the receptor surface. This avoids the transfer of adhesive from areas overlapping the indicia when pressure is applied to the carrier film in the vicinity of the indicia. As the indicia is adhered to the receptor surfaces by burnishing, it shears the adhesive along the outline of the indicia so that, essentially, more of the overlapping adhesive is transferred.

In order to achieve the above result, the pressure-sensitive adhesive should not be a highly cohesive film former. Proper formulation of resins and fillers achieve this result.

Using the proper combination of a support or carrier sheet, ink and adhesives selected to provide the aforementioned properties, a dry transfer decal was prepared as follows:

EXAMPLE 2

A 2 mil. thickness polyester film of low extensibility, coated with a styrenated alkyd resin of 1 mil. thickness, was printed with a lacquer-type printing ink of the following composition:

| Components | Parts by Wt. |
|---|---|
| vinyl chloride/vinyl acetate, copolymer | 100 |
| polyester plasticizer | 20 |
| cyclohexanone | 190 |
| carbon black | 15 |

The ink was dried in a forced-air oven and then coated with a pressure-sensitive adhesive of the following composition:

| Components | Parts by Wt. |
|---|---|
| styrene-butadiene rubber | 6.0 |
| polyterpene resin | 9.0 |
| silica filler | 3.0 |
| antioxidant | 0.3 |
| naphtha | 40.0 |
| mineral spirits | 41.7 |
| | 100.0 |

The indicia were transfered by placing the adhesive side of the dry transfer decal against a wallboard panel and applying pressure greater than 50 psi by means of a hydraulic press. Complete uniform transfer was achieved without the removal of adhesive from the support or carrier sheet. The sheet remained intact and essentially unchanged on inspection. The dry transfer sheets, prepared by this invention, remain unchanged even after storage of at least one year, and the indicia remained uniformly adhered to the carrier sheet until transferred.

The invention claimed is:

1. A dry transfer material comprising a nonextensible carrier sheet constructed of a light-transmitting polymer film of low extensibility under the stresses of light rubbing or burnishing, said sheet having a polymeric surface layer, said surface layer being substantially non-extensible and being susceptible to penetration by ink-carrying solvents, ink-printed indicia on said polymeric surface layer, said indicia being capable of being transferred to a receptor surface without the application of heat, and a pressure-sensitive adhesive coating overlying said indicia.

2. The material of claim 1 wherein said adhesive coating has greater adhesion to said indicia than the indicia has to said polymeric surface layer.

3. The material of claim 1 wherein said adhesive coating overlies both the indicia and the polymeric surface layer and has greater adhesion to said polymeric surface layer than to a receptor surface to which said material is applied.

4. The material of claim 1 wherein said ink-printed indicia is formed by an ink based upon a member selected from the group consisting of nitrocellulose, polyacrylate and polyvinyl chloride-polyvinyl acetate copolymers.

5. The material of claim 1 wherein said ink-carrying solvents are selected from the group consisting of aromatic hydrocarbons, esters, ketones, and ether alcohols.

6. A method of transfering indicia from one surface to another which comprises applying a transfer material to a receptor surface, said transfer material comprising (a) a carrier sheet constructed of a light-transmitting polymer film of low extensibility under the stresses of light rubbing or burnishing, said sheet having a substantially non-extensible polymeric surface layer which is susceptible to penetration by ink-carrying solvents, ink-printed indicia on said polymeric surface layer, said indicia being formed by a composition comprising solvents containing an ink adapted to from said printed indicia on said polymeric surface layer, and (b) a pressure-sensitive adhesive coating overlying the indicia formed by said ink, and then applying a predetermined pressure at ambient temperature, to said transfer material to transfer said indicia and the adhesive coating overlying said indicia to said receptor surface.

7. The method of claim 6 wherein said pressure is at least about 50 psi.

* * * * *